US005091356A

United States Patent [19]

Nakashima

[11] Patent Number: 5,091,356

[45] Date of Patent: * Feb. 25, 1992

[54] THERMOSENSITIVE RECORDING MEMBER

[75] Inventor: Norihiko Nakashima, Tochigi, Japan

[73] Assignee: Kao Corporation, Tokyo, Japan

[ * ] Notice: The portion of the term of this patent subsequent to Jan. 29, 2008 has been disclaimed.

[21] Appl. No.: 451,170

[22] Filed: Dec. 15, 1989

[30] Foreign Application Priority Data

Dec. 28, 1988 [JP] Japan ..... 63-331630

[51] Int. Cl.[5] ..... B41M 5/30; B41M 5/40

[52] U.S. Cl. ..... 503/200; 427/152; 503/207; 503/226

[58] Field of Search ..... 427/152; 503/200, 226, 503/207

[56] References Cited

U.S. PATENT DOCUMENTS 4,923,844 5/1990 Itabashi et al. ..... 503/207
4,925,827 5/1990 Goto et al. ..... 503/207
4,929,590 5/1990 Maruta et al. ..... 503/207

FOREIGN PATENT DOCUMENTS 59-5093 1/1984 Japan .
9171685 9/1984 Japan .
9225989 12/1984 Japan .
63-21180 1/1988 Japan .
1-275184 11/1989 Japan .

*Primary Examiner*—Pamela R. Schwartz
*Attorney, Agent, or Firm*—Birch, Stewart, Kolasch & Birch

[57] ABSTRACT

A thermosensitive recording member comprises (1) a substrate, (2) a foamed dispersion layer, provided on the substrate, in which an aqueous, self-emulsifiable resin having an I/O value of 0.6 to 1.1 has been dispersed, and (3) a thermosensitive coloring layer, provided on the foamed dispersion layer, containing an electron-donating dye and an electron-accepting compound to present a color by reacting with the dye, improved in sensitivity.

4 Claims, No Drawings

THERMOSENSITIVE RECORDING MEMBER

FIELD OF INDUSTRIAL APPLICATION

The present invention relates to a thermosensitive recording material, and more particularly, to a thermosensitive recording material having high coloring sensitivity.

PRIOR ART AND PROBLEMS TO BE SOLVED BY THE INVENTION

Thermosensitive recording materials are in general used for facsimiles, computers, and measuring instruments on account of their advantage that they need no maintenance, makes no noise, and are comparatively inexpensive.

With the recent advance of facsimiles for high-speed transmission and computers for high-speed print output, a strong demand has arisen for a thermosensitive recording material which has a high sensitivity, that is, one which forms a deep color with a lesser amount of energy.

To meet this demand, there have been proposed some ideas of providing a heat insulating barrier under the thermosensitive coloring layer, thereby utilizing heat from the thermal head effectively for the color forming reaction. According to Japanese Patent Laid-open No. 5093/1984, the heat insulating barrier is formed from an undercoat of thermally expandable minute hollow particles which is subsequently heated for foaming; according to Japanese Patent Laid-open No. 225987/1984, the heat insulating barrier is further coated with a pigment layer to make it smooth; and according to Japanese Patent Laid-open No. 171685/1984, the heat insulating barrier is formed from an undercoat layer composed of a thermoplastic resin and a gas-emitting agent which generates a gas upon heating. All of these methods need a heating-foaming process, which is very inefficient, and present difficulties in uniform foaming. As the result, they are not successful in providing a stable thermosensitive recording material.

SUMMARY OF THE INVENTION

It is an object of the present invention to provide an improved thermosensitive material which exhibits a high coloring sensitivity without the heating-foaming process.

In order to address the above-mentioned problem, the present inventors have carried out research which led to the finding that an improved thermosensitive recording material with a high coloring sensitivity can be obtained if the base is coated with foams of an aqueous dispersion of a resin which is prepared by vigorously stirring an aqueous dispersion of a resin by means of a stirrer such as dissolver and homomixer.

It was found, however, that the aqueous resin dispersion is poor in foam stability when it is prepared from water-soluble resins such as polyvinyl alcohol, starch, and carboxymethylcellulose or aqueous resin emulsions such as styrene butadiene latex, polyvinyl acetate emulsion, and polyacrylate ester emulsion. The dispersion forms an effective heat insulating barrier if it is applied immediately after gas emission, but the foam goes out with time. Therefore, the dispersion presents difficulties in stable, continuous coating on an industrial scale.

The foam stability is considerably improved when the aqueous dispersion of a resin is incorporated with a surface active agent such as sodium alkylsulfate, sodium alkyl-benzenesulfonate, sodium polyoxyalkylethersulfate, and polyoxyethylene alkyl ether, which are used as a foam stabilizer or foaming agent for shampoo and toothpaste. However, a surface active agent poses a serious problem on account of its ability to solubilize thermosensitive dyes. When an intermediate layer containing a surface active agent is coated with a thermosensitive paint, ground fogging occurs or colored images become unstable.

These facts suggest the necessity of a hydrophilic resin which provides foam stability without the aid of any surface active agent. With this in mind, the present inventors investigated the relationship between the resin composition and foam stability. As a result, it was found that a stable foam is obtained from a self-emulsifiable hydrophilic- resin having an I/0 value in the range of 0.6 to 1.1. (The I/O value is a ratio of "inorganicness" to "organicness" as a measure of hydrophile-lipophile balance.) The present invention was completed on the basis of this finding.

The present invention resides in an improved thermosensitive recording material of the type having a base and a thermosensitive coloring layer formed thereon containing an electron-donating dye and an electron-accepting compound capable of coloring upon reaction with said dye, wherein the improvement comprises foam of aqueous dispersion of a resin interposed between said base and said thermosensitive coloring layer, said resin dispersion containing a self-emulsifiable resin having an I/O value in the range of 0.6 to 1.1.

A thermosensitive recording member of the invention comprises (1) a substrate, (2) a foamed dispersion layer, provided on the substrate, in which an aqueous, self-emulsifiable resin having an I/O value of 0.6 to 1.1 has been dispersed, and (3) a thermosensitive coloring layer, provided on the foamed dispersion layer, containing an electron-donating dye and an electron-accepting compound to present a color by reacting with the and which is improved in sensitivity.

It is preferable that the aqueous resin has an average particle size of 0.001 to 0.2 microns and a number-average molecular weight of 2,000 to 200,000; the aqueous resin is a copolymer obtained from 2 to 25 wt. % of a double bond-having monomer having a salt-forming group and 98 to 75 wt. % of a co-monomer; and the foamed dispersion layer has an apparent specific gravity of 0.2 to 0.9 and a coated amount of 0.1 to 10 g per $m^2$.

The term "I/O value" (inorganicness value to organicness value) is fully described in "Yuki Gainenzu" (Organic Concetual Chart) by Y. Koda (published by Sankyo Shuppan, 1984). The "organicness value" is defined as a value of 20 for each carbon atom, and hence it can be calculated by multiplying the number of carbon atoms in a molecule by 20. The "inorganicness value" can be obtained from Table 1 showing the groups of inorganicness. In the case of a substituent having groups of both inorganicness and organicness, the value of organicness obtained as mentioned above should be added to the value of organicness shown in Table 1.

TABLE 1

| Groups of inorganicness | Groups of Inorganicness: Value | Groups of inorganicness having also organicness | Value of organic-ness | Value of inorgan-icness |
|---|---|---|---|---|
| Light metal (salt) | 500< | $R_4Bi—OH$ | 80 | 250 |
| Heavy metal (salt) amine & $NH_4$ salt | 400 < | $R_4Sb—OH$ | 60 | 250 |
| $—AsO_3H_2$, $>AsO_3H$ | 300 | $R_4As—OH$ | 40 | 250 |
| $—SO_2—NH—CO—$, $—N=N—NH_2$ | 260 | $R_4P—OH$ | 20 | 250 |
| $=N^+—OH$, $—SO_3H$, $—NH—SO_2—NH—$ | 250 | $—OSO_3H$ | 20 | 220 |
| $—CO—NH—CO—NH—CO—$ | 250 | $>SO_2$ | 40 | 170 |
| $—S—OH$, $—CO—NH—CO—NH—$ | 240 | $>SO$ | 40 | 140 |
| $—SO_2—NH—$ | 240 | $—CSSH$ | 100 | 80 |
| $—CS—NH—$*, $—CO—NH—CO—$* | 230 | $—SCN$ | 90 | 80 |
| $=N—OH$, $—NH—CO—NH—$* | 220 | $—CSOH$, $—COSH$ | 80 | 80 |
| $=N—NH—$*, $—CO—NH—NH_2$ | 210 | $—NCS$ | 90 | 75 |
| $—CO—NH—$* | 200 | $—Bi<$ | 80 | 70 |
| $—N\rightarrow O$ | 170 | $—NO_2$ | 70 | 70 |
| $—COOH$ | 150 | $—Sb<$ | 60 | 70 |
| Lactone ring | 120 | $—As<$ . $—CN$ | 40 | 70 |
| $—CO—O—CO—$ | 110 | $—P<$ | 20 | 70 |
| Anthracene & phenanthrene nuclei | 105 | $—O—[—CH_2—CH_2—O—]—CH_2—^+$ | 30 | 60 |
| $—OH$ | 100 | $—CSS\phi$ | 130 | 50 |
| $>Hg$ (covalent bond) | 95 | $—CSO\phi$, $—COS\phi$ | 80 | 50 |
| $—NH—NH—$, $—O—CO—O—$ | 80 | $—NO$ | 50 | 50 |
| $—N<$ ($—NH_2$, $—NH\phi$, $—N\phi_2$) aminic | 70 | $—O—NO_2$ | 60 | 40 |

TABLE 1-continued

| Groups of inorganicness | Groups of Inorganicness: Value | Groups of inorganicness having also organicness | Value of organicness | Value of inorganicness |
|---|---|---|---|---|
| $>CO$ | 65 | —NC | 40 | 40 |
| —COOϕ, naphthalene and quinoline nuclei | 60 | —Sb=Sb— | 90 | 30 |
| $>C=NH$ | 50 | —As=As— | 60 | 30 |
| —O—O— | 40 | —P=P—, —NCO | 30 | 30 |
| —N=N— | 30 | —O—NO—, —SH, —S— | 40 | 20 |
| —O— | 20 | —I | 80 | 10 |
| Benzene nucleus (aromatic monocyclic) | 10 | —Br | 60 | 10 |
| Ring (non-aromatic monocyclic) | 10 | =S | 50 | 10 |
| Triple bond | 3 | —Cl | 40 | 10 |
| Double bond | 2 | —F | 5 | 5 |
| | | Iso branch** $>$— | −10 | 0 |
| | | Tert branch** $>$— | −20 | 0 |

Note to Table 1
The organicness value ascribed to the number of carbon atoms in the group of inorganicness should be added to the organicness value. However, it is assumed that the one in the group having both inorganicness and organicness has been added to that in the group of organicness.
*applied to the non-cyclic moiety
**applied to the terminal moiety
+the value of the moiety in bracket [ ]

Note to Table 1

The organicness value ascribed to the number of carbon atoms in the group of inorganicness should be added to the organicness value. However, it is assumed that the one in the group having both inorganicness and organicness has been added to that in the group of organicness.

* applied to the non-cyclic moiety

** applied to the terminal moiety

\+ the value of the moiety in bracket [ ]

The I/O value is obtained by dividing the value of inorganicness by the value of organicness. The higher the I/O value, the stronger the hydrophilicity; and the lower the I/O value, the stronger the hydrophobicity.

According to the present invention, the self-emulsifiabl hydrophilic resin should have an I/O value in the range of 0.6 to 1.1. With an I/O value lower than 0.6, the resin has such a strong hydrophobicity that it cannot be made into a stable aqueous dispersion without the aid of a surface active agent. With an I/O value higher than 1.1, the resin has too strong hydrophilicity that it does not permit foam to exist at the gas/liquid interface and hence does not a stable foam.

Examples of the self-emulsifiable hydrophilic resin having an I/O value in the range of 0.6 to 1.1 which can be used in the present invention include styrene-sodium acrylate copolymer (92/8, I/O=0.73), styrene-methyl methacrylate-triethylamine acrylate copolymer (72/20/8, I/O=0.88), lauryl methacrylate-sodium acrylate copolymer 92/8, I/O =0.89), n-butyl acrylate-triethanolamine acrylate copolymer (96/4, I/O=0.91), and styrene-methyl methacrylate-triethylamine acrylate copolymer (49/43/8, I/O=1.06). These examples are not limiting. According to the present invention, the self-emulsifiable resin is made into an aqueous dispersion. An aqueous dispersion of an acrylic resin having an average particle diameter as small as 0.001 to 0.2 μm is particularly desirable from the standpoint of foam stability and film-forming property.

This aqueous dispersion may be prepared in the following manner. A monomer having a polymerizable double bond (with a salt-forming group) and another monomer having a polymerizable double bond (copolymerizable with said monomer) are subjected to bulk polymerization, and the resulting polymer is dissolved in a hydrophilic organic solvent. Alternatively, the monomers undergo solution polymerization in a hydrophilic organic solvent and the resulting polymer solution is incorporated with a neutralizing agent to ionize the salt-forming group, if necessary. Subsequently, the hydrophilic organic solvent is distilled away after the addition of water.

The monomer having a polymerizable double bond (with a salt-forming group) may be anionic, cationic, or amphoteric. Examples of the anionic monomer include unsaturated carboxylic acid monomer, unsaturated sulfonic acid monomer, and unsaturated phosphoric acid monomer. Examples of the cationic monomer include unsaturated tertiary amine-containing monomer and unsaturated ammonium salt-containing monomer. Examples of the amphoteric monomer include N-(3-sulfopropyl)-N-methacryloxyethyl-N, N-diethylammonium betaine, N-(3-sulfopropyl)-N-meth-acrylamidepropyl-N, N-dimethylammonium betaine, and 1-(3-sulphopropyl-2-vinylpyridinium betaine.

Examples of the- unsaturated carboxylic acid monomer include acrylic acid, methacrylic acid, crotonic acid, itaconic acid, maleic acid, fumaric acid, citraconic acid, and anhydrides thereof.

Examples of the unsaturated sulfonic acid monomer include styrene sulfonic acid, 2-acrylamide-2-methylpropanesulfonic acid, 3-sulfopropyl(meth)acrylic acid ester, and bis-(3-sulfopropyl)-itaconic acid ester, and salts thereof. Additional examples include sulfate monoester and salt thereof of 2-hydroxyethyl (meth)acrylic acid.

Examples of the unsaturated phosphoric acid monomer include vinyl phosphonic acid, vinyl phosphate, acid phosphoxyethyl (meth)acrylate, 3-chloro-2-acid phosph-oxypropyl (meth)acrylate, acid phosphoxypropyl (meth)acrylate, bis(methacryloxyethyl)phosphate, diphenyl-2-methacryloyloxyethyl phosphate, diphenyl-2-acryloyloxyethyl phosphate, dibutyl-2-methacryloyloxyethyl phosphate, dibutyl-2-acryloyloxyethyl phosphate, and dioctyl-2-(meth)acryloyloxyethyl phosphate.

Included among the cationic monomers are unsaturated tertiary amine-containing monomers and unsaturated ammonium salt-containing monomers. Their examples include monovinylpyridines such as vinylpyridine, 2-methyl-5-vinylpyridine, 2-ethyl-5-vinylpyridine; styrenes having a dialkylamino group such as N,N-dimeth-ylaminostyrene and N,N-dimethylaminostyrene; acrylic or methacrylic ester having a dialkylamino group such as N,N-dimethylaminoethyl methacrylate, N,N-dimethylaminoethyl acrylate, N,N-diethylaminoethyl acrylate, N,N-diethylaminoethyl acrylate, N,N-dimethylaminopropyl methacrylate, N,N-dimethylaminopropyl acrylate, N,N-diethylaminopropyl methacrylate, and N,N-diethylaminopropyl acrylate; vinyl ethers having a dialkylamino group such as 2-dimethylaminoethyl vinyl ether; acrylamides or methacrylamides having a dialkylamino group such as N-(N',N'-dimethylaminoethyl)methacrylamide, N-(N',N'-dimethyl-aminoethyl)acrylamide, N-(N',N'-diethylaminoethyl)methacrylamide, N-(N',N'-diethylaminoethyl)acrylamide, N-(N'-N'-dimethylaminopropyl)methacrylamide, N-(N',N'-dimethylaminopropyl)acrylamide, N-(N',N'-diethylamino-propyl)methacrylamide, and N-(N',N'-diethylaminopropyl)-acrylamide; and quaternized products thereof formed by reacting them with a known quaternizing agent such as alkyl ($C_{1-18}$) halide (Cl, Br, or I), benzyl halide (e.g., benzyl chloride and benzyl bromide), alkyl ($C_{1-18}$) ester of alkyl- or arylsulfonic acid (e.g., methanesulfonic acid, benzenesulfonic acid, and toluenesulfonic acid), and dialkyl ($C_{1-4}$) sulfate.

According to the present invention, the monomer having a polymerizable double bond (with a salt-forming group) and the monomer having a polymerizable double bond copolyymerizable with said monomer should be used in a ratio of 2–25 wt % to 98–75 wt %. With an amount less than 2 wt %, the former does not provide a stable dispersion of self-emulsifiable resin having a uniform particle diameter. On the other hand, with an amount in excess of 25 wt %, it does not provide a resin having practical water resistance.

Examples of the latter monomers include acrylic esters such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate, and dodecyl acrylate; methacrylic esters such as methyl methacrylate, ethyl methacrylate, propyl methacrylate, n-butyl methacrylate, isobutyl methacrylate, n-amyl methacrylate, n-hexyl methacrylate, n-octyl methacrylate, 2-ethylhexyl methacrylate, and dodecyl methacrylate; styrene-based monomers such as styrene, vinyltoluene, 2-methylstyrene, 1-butylstyrene, and chlorostyrene; hydroxyl group-containing monomers such as hydroxyethyl acrylate and hydroxypropyl acrylate; N-substituted (meth)acrylic monomers such as N-methylol (meth)acrylamide and N-butoxy-methyl (meth)acrylamide; epoxy group-containing monomers such as glycidyl acrylate and glycidyl methacrylate; and acrylonitrile. They may be used alone or in combination with one another.

The hydrophilic organic solvent used in the present invention is one or more than one kind selected from ketone solvents, alcohol solvents, ester solvents, and ether solvents.

Examples of ketone solvents include acetone, methyl ethyl ketone, diethyl ketone, dipropyl ketone, methyl isobutyl ketone, and methyl isopropyl ketone. Preferable among them is methyl ethyl ketone.

Examples of alcohol solvents include methanol, ethanol, n-propanol, isopropanol, n-butanol, secondary butanol, tertiary butanol, isobutanol, diacetone alcohol, and 2-iminoethanol. Preferable among them are isopropanol, n-propanol, n-butanol, secondary butanol, tertiary butanol, and isobutanol.

Examples of ester solvents include acetate esters, and examples of ether solvents include dioxane and tetrahydrofuran.

The hydrophilic organic solvent should preferably be one which has a lower boiling point and lower azeotropic point than water. However, it may be used in combination with a high-boiling hydrophilic organic solvent.

Examples of hydrophilic organic solvents having high-boiling point include phenoxy ethanol, ethylene glycol monomethyl ether, ethylene glycol monobutyl ether, diethylene glycol monomethyl ether, diethylene glycol monoethyl ether, diethylene glycol diethyl ether, diethylene glycol monobutyl ether, and 3-methyl-3-methoxybutanol.

A uniform, stable dispersion of a self-emulsifiable resin is prepared from the above-mentioned raw materials in the following manner. A hydrophilic solvent is placed in a reactor equipped with a stirrer, reflux condenser, dropping funnel, thermometer, and nitrogen inlet tube. The dropping funnel is charged with a copolymerizable monomer mixture, a radical initiator (in an amount of 0.05–5.0 wt % of the total monomers), and an optional chain transfer agent. The reaction is completed under refluxing at 50° C. or above in a nitrogen gas stream. If necessary, a neutralizing agent is added to neutralize the salt-forming group. (This step is not necessary if the salt-forming group is a quaternary ammonium salt of an amphoteric group.) Then, deionized water is added. Finally, the hydrophilic organic solvent is distilled away under reduced pressure at 50° C. or below.

In the case of the polymer containing a tertiary amine, the tertiary amino group is quaternized with a known quaternizing agent after completion of the reaction in the solvent. Subsequently, deionized water is added. Finally, the hydrophilic organic solvent is distilled away under reduced pressure at 50° C. or below.

The initiator used in this reaction may be a known radical initiator and it includes hydroperoxides represented by t-butylhdyroperoxide; dialkyl peroxides represented by di-t-butyl peroxide; diacyl peroxides represented by acetyl peroxide; peracid esters such as t-butyl peracetate; ketone peroxides represented by methyl ethyl ketone; and azo initiators represented by 2,2'-azobis(isobutyronitrile), 2,2'-azobis(2,4-dimethylvaloronitrile), and 1,1'-azobis(cyclohexane-1-carbonitrile). The thus obtained self-exulsifiable resin dis-persion has almost perfect transparency and has Tyndall phenomenon when a laser beam is applied.

The self-emulsifiable resin prepared as mentioned above should preferably have a number-average molecular weight of 2,000 to 200,000.

The self-emulsifiable resin can be converted into a foam possessing resin by vigorous stirring with a high-speed stirrer such as a homomixer and dissolver. The foam suitable for use in the present invention should have an apparent density of 0.2 to 0.9. With an apparent density lower than 0.2, the foam is poor in coating performance With an apparent density higher than 0.9, the foam does not improve the coloring sensitivity on account of its low foam content.

The thus obtained foam should be applied to the base preferably by bar coating, rod coating, die coating, or kiss coating. The coating amount should be 0.1–10 $g/m^2$, preferably 0.5–5 $g/m^2$.

The electron-donating dye (color former) used in the present invention is selected from leuco dyes such as triphenylmethane dyes, fluoran dyes, phenothiazine dyes, auramine dyes, spiropyran dyes, and indolinophthalide dyes. They may be used alone or in combination with one another. Their examples are listed below; they are not limitative, however.

3,3-bis(p-diemthylaminophenyl)phthalide,
3,3-bis(p-diemthylaminophenyl)-6-dimethylaminophthalide,
3,3-bis(p-diemthylaminophenyl)-6-diethylaminophthalide,
3,3-bis(p-diemthylaminophenyl)-6-chlorophthalide,
3,3-bis(p-dibutylaminophenyl)phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-dibenzfuloran,
3-diethylamino-6-methyl-7-chlorofuloran,
3-(N-p-tolyl-N-ethylamino)-6-methyl-7-anilinofluoran,
3-pyrolidino-6-methyl-7-anilinofluoran,
2-(N-(3'-trifluoromethylphenyl)amino-6-diethylaminofluoran,
(3,6-bis(diethylamino)-9-(o-chloroanilino)xanthyl benzoic acid lactam,
3-diethylamino-6-methyl-7-(m-trichloromethylanilino)fluoran,
3-diethylamino-7-(o-chloroanilino)fluoran,
3-butylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran,
benzoyl leuco methylene blue,
6'-chloro-8'-methoxy-benzoindolino-pyrylospyran,
6'-bromo-8'-methoxy-benzoindolino-pyrylospyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)fluoran,
3-pyrodino-7-trifluoromethylanilinofluoran,
3-diethylamino-5-chloro-7-(N-benzyl-trifluoromethylanilino)fluoran,
3-pyrrolidino-7-(di-p-chlorophenyl)methylanilinofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylamino)fluoran,
3-diethylamino-7-pyperidinofluoran,
2-chloro-3-(N-methyltoluidino)-7-(p-n-butylanilino)-fluoran,
3-(N-benzyl-N-cyclohexylamino)-5,6-benzo-7-α-naphthyl-amino-4'-bromofluoran,
3-dethylamino-6-methyl-7-mesitydino-4',5'-benzofluoran,
3,6-dimethoxyfluoran,
3-(p-dimethylaminophenyl)-3-phenylphthalide,
3-di(1-ethyl-2-methylindol)-3-yl-phthalide,
3-diethylamino-6-phenyl-7-azafluoran,
3,3-bis(p-diethylaminophenyl)-6-diemthylamino-phthalide,
2-bis(p-dimethylaminophenyl)methyl-5-dimethylaminobenzoic acid,
3-(p-dimethylaminophenyl)-3-(p-benzylamino-phenyl)phthalide, and
3-(N-ethyl-N-n-amyl)amino-6-methyl-7-anilinofluoran.

The electron-accepting compound (developer) used in the present invention is not specifically limited so long as it develops a color on reaction with the electron-donating dye. It includes phenol compounds, organic acids or metal salts thereof, and hydroxybenzoic acid esters. Typical examples are listed below.

Salicylic acid, 3-isopropylsalicylic acid, 3-cyclohexylsalicylic acid, 3,5-di-tert-butylsalicylic acid, 3,5-di-α-methylbenzylsalicylic acid, 4,4'-isopropylidenediphenol, 4,4'-isopropylidene-bis(2-chlorophenol), 4,4'-isorppylidene-bis(2,6-dibromophenol), 4,4'-isopropylidene-bis(2,6-dichlorophenol), 4,4'-isopropylidenebis(2-methylphenol), 4,4'-isopropylidene-bis(2,6-dimethylphenol), 4,4'-isopropylidene-bis(2-tert-butylphenol) 4,4'-sec-butylidenediphenol, 4,4'-sec-butylidenediphenol, 4,4'-cyclohexylidenebisphenol, 4,4'-cyclohexylhexylidene-bis,-(2-methylphenol), 4-ter-butylphenol, 4-phenylphenol 4-hydroxydiphenoxide, α-naphthol, β-naphthol, 3,5-xylenol, thymol, methyl-4-hydroxybenzoate, 4-hydroxy-acetophenone, novolak-type phenolic resin, 2,3'-thiobis(4,6-dichlorophenol), catechol, resorcinol, hydroquinone, pyrogallol, phloroglucin, phloroglucincarboxylic acid, 4-tert-octylcatechol, 2,2'-methylene-bis(4-chlorophenol), 2,2'-methylene-bis(4-methyl-6-tert-butylphenol), 2,2'-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, benzoic acid, zinc salicylate, 1-hydroxy-2-naphthoic acid, 2-hydroxy-6-naphthoic acid, zinc 2-hydroxy-6-naphthoate, 4-hydroxydiphenylsulfone, 4-hydroxy-4'-chlorodiphenylsulfone, bis(4-hydroxyphenyl)sulfide, 2-hydroxy-p-toluic acid, zinc 3,5-tert-butylsalicylate, tin 3,5-di-tert-butylsalicylate, tartaric acid, oxalic acid, malic acid, citric acid, succinic acid, stearic acid, 4-hydroxyphthalic acid, boric acid, thiourea derivatives, and 4-hydroxythiophenol derivatives.

In the case where the developer has a high melting point, it may be used in combination with a low-melting point substance to increase the sensitivity. In this case, the low-melting point substance may be atomized or emulsified separately from the developer and then the powder or emulsion is mixed with the developer; the low-melting point substance and the developer are fused together and then atomized; or the low-melting point substance is fusion-bonded to the surface of the developer particles. Any method will do.

Examples of the low-melting point substance include high fatty acid amides such as stearamide, erucamide, palmitamide, and ethylene-bis-steraramide; ethers such as 1,2-bis(phenoxy)ethane and 2-naphtholbenzyl ether; and higher fatty acid esters such as dibenzyl terephthalate and phenyl 1-hydroxy-2-naphthoate. They have a melting point in the range of 50° to 120° C.

According to the present invention, the color former and developer are used in the form of fine particles (several microns in diameter) in a dispersion medium. The dispersion medium is usually an aqueous solution of a water-soluble polymer in a concentration of up to about 10%. Examples of the water-soluble polymer include polyvinyl alcohol; starch and derivatives thereof; cellulose derivatives such as methylcellulose, hydroxyethylcellulose, and carboxymethylcellulose; synthetic polymers such as sodium polyacrylate, polyvinylpyrrolidone, acrylamide-acrylate ester copolymer, and acrylamide-acrylate ester-methacrylic acid copolymer; sodium alginate; casein; and gelatin. They may be dispersed by the aid of a ball mill, sandmill, or attritor.

The water-soluble polymer functions, after coating, as a binder for the thermosensitive paint components. The coating liquid is incorporated with a water-resisting material or polymer emulsion (such as styrene-butadiene latex and an acrylic emulsion) to impart water resistance to the binder.

The thus obtained thermosensitive coating liquid is further incorporated with a variety of additives. They include an oil-absorbing substance such as inorganic pigment to prevent the recording head from fouling, and a fatty acid or metal soap to improve the running performance of the head. Examples of the inorganic pigment include kaolin, talc, calcium carbonate, aluminum hydroxide, magnesium hydroxide, magnesium carbonate, titanium oxide, and silica in fine particulate form. Examples of the fatty acid and metal soap include stearic acid, behenic acid, aluminum stearate, zinc stearate, calcium stearate, and zinc oleate.

The foam of the aqueous resin dispersion is placed on the base (paper or film) to foam the foam layer and the thermosensitive paint composed of the above-mentioned components is coated on the foam layer by blade coating, air knife coating, bar coating, rod coating, gravure coating, or roll coating, followed by drying and smoothing, thereby forming the thermosensitive coloring layer. In this way there is obtained the thermosensitive recording material of the present invention.

EXAMPLES

The invention will be described in more detail with reference to the following examples, which are not intended to restrict the scope of the invention. In Examples, "parts" and "%" mean parts by weight and wt %, respectively.

SYNTHESIS EXAMPLE 1

In a reactor equipped with a stirrer, reflux condenser, dropping funnel, thermometer, and nitrogen inlet tube placed 64 parts of methyl ethyl ketone, 56 parts of styrene, and 8 parts of acrylic acid were charged. The reactants were free of dissolved oxygen by blowing nitrogen.

With the reactor heated to 80° C., polymerization was initiated by adding 0.13 part of azobisisobutyronitrile dissolved in 2 parts of methyl ethyl ketone. Further, 36 parts of styrene (dissolved in 36 parts of methyl ethyl ketone) and 0.07 part of azobisisobutyronitrile (dissolved in 10 parts of methyl ethyl ketone) were added from the dropping funnel over 3 hours.

After the dropwise addition of the monomers, 0.2 part of azobisisobutyronitrile (dissolved in 3 parts of methyl ethyl ketone) was added, and the reaction product was allowed to stand for 2 hours for ageing. Thus there was obtained a uniform solution of copolymer.

To the solution were added 11.5 parts of triethylamine for neutralization and then 300 parts of deionized water. The solution was freed of methyl ehtyl ketone by distillation under reduced pressure at 50° C. or below. Thus there was obtained a self-emulsifiable hydrophilic vinyl resin containing 25% solids and having a viscosity of 30 cp.

This resin emulsion was clear but produced the Tyndall phenomenon when irradiated with a laser beam. It was found to have a particle diameter of 0.015 μm measured by Coulter, Model N4, made by Coulter Electronics Inc.

SYNTHESIS EXAMPLES 2 TO 8

The same procedure as in Synthesis Example 1 was repeated except that the monomers were replaced by those listed in Table 2. Thus there were obtained a variety of dispersions (containing 25% solids) of self-emulsifiable hydrophilic resins.

SYNTHESIS EXAMPLE 9

In a reactor equipped with a stirrer, reflux condenser, dropping funnel, thermometer, and nitrogen inlet tube, 10 parts of "Neopelex F-25 " surface active agent (alkylbenzenesulfonate made by Kao Co., Ltd.), 300 parts of deionized water, 0.2 part of potassium persulfate, 8 parts of ethyl acrylate, and 2 parts of butyl acrylate were charged. After introducing nitrogen in to the reactor, the reactants were heated to 75° C. and polymerization was initiated. To the reactor was added dropwise a mixture composed of 52 parts of ethyl acrylate and 13 parts of butyl acrylate from the dropping funnel over 2 hours. The reaction product was aged at 80° C. for 1 hour. Thus there was obtained a dispersion (containing 25% solids) of a resin of emulsion polymerization type having a particle diameter as shown in Table 2.

SYNTHESIS EXAMPLE 10 the same procedure as in Synthesis Example 9 was repeated except that the monomers were replaced by those listed in Table 2. Thus there were obtained a dispersion (containing 25% solids) of a resin of emulsion polymerization type.

TABLE 2

| Synthesis Example No. | Monomer Composition (A) | (B) | (C) | (D) | Molar ratio (%) (A) | (B) | (C) | (D) | I/O | Particle diameter (μm) |
|---|---|---|---|---|---|---|---|---|---|---|
| 1 | Styrene | Triethylamine acrylate | | | 92 | 8 | | | 0.73 | 0.015 |
| 2 | Styrene | 2-ethylhexyl acrylate | Triethylamine acrylate | | 57 | 35 | 8 | | 0.84 | 0.011 |
| 3 | n-butyl acrylate | Triethylamine acrylate | | | 96 | 4 | | | 0.91 | 0.020 |
| 4 | Lauryl methacrylate | Sodium acrylate | | | 92 | 8 | | | 1.03 | 0.053 |
| 5 | Styrene | Methyl methacrylate | n-butyl methacrylate | Triethanol-amine acrylate | 42 | 37 | 13 | 8 | 1.08 | 0.024 |
| 6 | Styrene | Potassium methacrylate | | | 94 | 6 | | | 0.52 | 0.075 |
| 7 | Styrene | Methyl methacrylate | Triethylamine acrylate | | 20 | 72 | 8 | | 1.28 | 0.013 |
| 8 | Methyl methacrylate | Ethyl acrylate | Sodium acrylate | | 60 | 32 | 8 | | 1.56 | 0.011 |
| 9 | Ethyl acrylate | Butyl acrylate | | | 80 | 20 | | | 0.80 | 0.23 |
| 10 | Vinyl acetate | | | | 100 | | | | 1.06 | 0.25 |

PREPARATION EXAMPLES 1 AND 2

Aqueous solutions (25% of water-soluble polymers were prepared as shown in Table 3.

TABLE 3

| Preparation Example No. | Water-soluble polymer | I/O |
|---|---|---|
| 1 | Polyvinyl alcohol | 2.50 |
| 2 | Poly(sodium acrylate) | 9.75 |

EXAMPLES 1 TO 5

Each of the dispersions of self-emulsifiable resins (shown in Table 2) obtained in Synthesis Examples 1 to 5 was stirred at 5000 rpm for 1 hour using a T.K. homomixer (made by Tokushu Kika Kogyo Co., Ltd.) to make foam. This foam was applied (for undercoating) to a commercial superior paper (having a basis weight of 53 g/m$^2$) using a wire bar. (Coating weight: 3.5 g/m$^2$).

Each of liquid A, liquid B, and liquid C (shown below) was atomized using a sand mill until the average particle diameter was smaller than 3 μm. A thermosensitive paint was prepared by mixing 1 part of liquid A, 3 parts of liquid B, and 3 parts of liquid C. This thermosensitive paint was applied to the paper to which the foam of aqueous resin dispersion had previously been applied. (Coating weight: 5 g/m$^2$ on solid basis). After drying, the coated paper was smoothed by supercalendering. Thus there was obtained thermosensitive paper.

| | | |
|---|---|---|
| Liquid A | 3-N-methyl-N-cyclohexylamino-6-methyl-7-anilinofuloran | 10 parts |
| | 10% aqueous solution of polyvinyl alcohol | 20 parts |
| Liquid B | 4,4'-isopropylidenediphenol | 10 parts |
| | 10% aqueous solution of polyvinyl alcohol | 20 parts |
| Liquid C | Dibenzyl terephthalate | 10 parts |
| | Calcium carbonate | 10 parts |
| | 10% aqueous solution of polyvinyl alcohol | 20 parts |
| | Water | 20 parts |

COMPARATIVE EXAMPLES 1 TO 5

The same procedure as in Examples 1 to 5 was repeated except that the dispersion of resin without foaming was applied (for undercoating) onto the base. Thus there were obtained five kinds of thermosensitive paper.

COMPARATIVE EXAMPLE 6

The same procedure as in Example 1 was repeated except that the thermosensitive paint was applied to the base without undercoating. Thus there were obtained thermosensitive paper.

The various kinds of thermosensitive paper obtained in Examples 1 to 5 and Comparative Examples 1 to 6 were tested for dynamic coloring using a printing tester made by Okura Denki Co., Ltd. The color density produced with printing energy of 0.4 mJ/dot was measured using a Macbeth RD-918 densitometer. The results are shown in Table 4.

TABLE 4

| | Undercoating: Aqueous resin | Undercoating: Foaming | Color density |
|---|---|---|---|
| Example 1 | Synthesis Example 1 | With foaming | 1.31 |
| Example 2 | Synthesis Example 2 | With foaming | 1.28 |
| Example 3 | Synthesis Example 3 | With foaming | 1.32 |
| Example 4 | Synthesis Example 4 | With foaming | 1.34 |
| Example 5 | Synthesis Example 5 | With foaming | 1.32 |
| Comparative Example 1 | Synthesis Example 1 | Without foaming | 1.02 |
| Comparative Example 2 | Synthesis Example 2 | Without foaming | 1.04 |
| Comparative Example 3 | Synthesis Example 3 | Without foaming | 1.00 |
| Comparative Example 4 | Synthesis Example 4 | Without foaming | 1.00 |
| Comparative Example 5 | Synthesis Example 5 | Without foaming | 1.03 |
| Comparative Example 6 | Without undercoating | | 0.96 |

It is noted from Table 4 that a high coloring sensitivity was obtained in Examples 1 to 5 in which the self-emulsifiable resin in the form of foam is applied to the base to form an intermediate layer, which was subsequently coated with a thermosensitive paint. It is also noted that sensitivity in Comparative Example 6 in which undercoating was not made is slightly higher than that in Comparative Examples 1 to 5 in which the emulsifiable resin of the same composition was applied without foaming. Nevertheless, the sensitivity is still lower than the practical level.

EXAMPLES 6 TO 10 AND COMPARATIVE EXAMPLES 7 TO 15

The resin dispersion shown in Table 5 was subjected to foaming in the same manner as in Example 1. The resulting foam had an apparent density of about 0.5. The foam was applied immediately after or one day after preparation to a commercial superior paper having a basis weight of 52.7 g/m$^2$ using a blade coater. (Coating weight: 3 g/m$^2$).

Each of liquid A and liquid B (shown below) was atomized using a sand mill until the average particle diameter was smaller than 3 μm. A thermosensitive paint was prepared by mixing 1 part of liquid A and 10 parts of liquid B. This thermosensitive paint was applied to the paper to which the foam of resin dispersion had previously been applied. (Coating weight: 5 g/m$^2$ on solid basis). After drying, the coated paper was smoothed by supercalendering. Thus there was obtained thermosensitive paper.

| | | |
|---|---|---|
| Liquid A | 3-diethylamino-6-methyl-7-anilinofuloran | 15 parts |
| | 10% aqueous solution of polyvinyl alcohol | 15 parts |
| | Water | 20 parts |
| Liquid B | benzyl p-hydroxybenzoate | 5 parts |
| | stearic acid monoglyceride | 5 parts |
| | calcium carbonate | 10 parts |
| | 10% aqueous solution of polyvinyl alcohol | 20 parts |
| | "Demor EP" (dispersing agent, made by Kao Co., Ltd.) | 0.5 part |

TABLE 5

| Example No. | Aqueous resin | I/O |
|---|---|---|
| Example 6 | Synthesis Example 1* | 0.73 |
| Example 7 | Synthesis Example 2* | 0.84 |
| Example 8 | Synthesis Example 3* | 0.91 |
| Example 9 | Synthesis Example 4* | 1.03 |
| Example 10 | Synthesis Example 5* | 1.08 |
| Comparative Example 7 | Synthesis Example 6* | 0.52 |
| Comparative Example 8 | Synthesis Example 7* | 1.28 |
| Comparative Example 9 | Synthesis Example 8* | 1.56 |
| Comparative Example 10 | Synthesis Example 9** | 1.06 |
| Comparative Example 11 | Synthesis Example 10** | 0.80 |
| Comparative Example 12 | Preparation Example 1*** | 2.50 |
| Comparative Example 13 | Preparation Example 2*** | 9.75 |
| Comparative Example 14 | Preparation Example 1 and sodium laurylsulfate (5%) | — |
| Comparative Example 15 | without undercoating | — |

*Aqueous resin of self-emulsifiable type
**Aqueous resin of emulsion polymerization type
***Water-soluble polymer The thus obtained thermosensitive paper was evaluated in the following manner.

(1) Effect of Foam on the Stability of Paint

The foam was applied to the paper base immediately after or one day after foaming and then the thermosensitive paint was applied to the foam layer. The thus prepared thermosensitive paper was tested for printing performance. The paint stability index (S) was calculated according to the following formula from the color density (with printing energy of 0.4 mJ/dot).

$$S = \frac{B}{A}$$

where:

A: color density of thermosensitive paper onto which the foam was applied immediately after foaming, and B: color density of thermosensitive paper onto which the foam was applied one day after foaming.

The greater the S value, the better the paint stability.

(2) Ground Fogging

The sample (coated with foam immediately after foaming) used in (1) above was examined for the color density of the ground. The color density was regarded as the ground fogging. The smaller the value of ground fogging, the better the thermosensitive paper.

(3) Image Stability

The printed sample produced in (1) above was allowed to stand for one month at room temperature, and the color density of the printed part was measured again. The retention (D) of the color density was calculated according to the following formula. The value of D is a measure of image stability.

$$D = \frac{C}{A} \times 100\ (\%)$$

where:

A: color density measured immediately after color development, and

C: color density measured one month after color development.

The greater the D value, the better the image stability.

The results of evaluation are shown in Table 6.

TABLE 6

| | Effect of foam on paint stability | | | | Image stability | | |
|---|---|---|---|---|---|---|---|
| Example No. | Immediately after (A) | One day after (B) | Stability index (S) | Ground fogging | Immediately after (A) | One month after (C) | Retention of density (D) |
| 6 | 1.38 | 1.36 | 0.99 | 0.07 | 1.38 | 1.29 | 93% |
| 7 | 1.40 | 1.37 | 0.98 | 0.07 | 1.40 | 1.31 | 94% |
| 8 | 1.40 | 1.35 | 0.96 | 0.08 | 1.40 | 1.30 | 93% |
| 9 | 1.42 | 1.38 | 0.97 | 0.07 | 1.42 | 1.29 | 91% |
| 10 | 1.37 | 1.36 | 0.99 | 0.07 | 1.37 | 1.30 | 95% |
| (7) | 0.75* | 0.68 | 0.91 | 0.07 | 0.75 | 0.68 | 91% |
| (8) | 1.31 | 1.17 | 0.89 | 0.08 | 1.31 | 1.22 | 93% |
| (9) | 1.33 | 1.15 | 0.86 | 0.07 | 1.33 | 1.21 | 91% |
| (10) | 1.25 | 1.09 | 0.87 | 0.17 | 1.25 | 0.89 | 71% |
| (11) | 1.21 | 1.09 | 0.90 | 0.15 | 1.21 | 0.92 | 76% |

TABLE 6-continued

| Example No. | Effect of foam on paint stability | | | Ground fogging | Image stability | | |
|---|---|---|---|---|---|---|---|
| | Immediately after (A) | One day after (B) | Stability index (S) | | Immediately after (A) | One month after (C) | Retention of density (D) |
| (12) | 1.27 | 1.04 | 0.82 | 0.08 | 1.27 | 1.15 | 91% |
| (13) | 1.23 | 1.10 | 0.89 | 0.10 | 1.23 | 1.11 | 90% |
| (14) | 1.29 | 1.23 | 0.95 | 0.13 | 1.29 | 0.98 | 76% |
| (15) | 1.07 | — | — | 0.07 | 1.07 | 1.01 | 94% |

Parenthesized example numbers indicate Comparative Examples.
*Foam coagulation.

It is noted from Table 6 that the samples of thermosensitive paper in Examples 6 to 10 are all superior in paint stability, ground fogging, and image stability. In Comparative Example 7, in which the self-emulsifiable resin has an I/O value smaller than 0.6, coagulation occurred during mechanical foaming probably because the resin is excessively hydrophobic, and hence the resulting thermosensitive paper is very poor in coloring sensitivity. In Comparative Examples 8 and 9, in which the self-emulsifiable resin has an I/O value greater than 1.1, the foam of the resin dispersion is unstable and hence the resulting thermosensitive paper is poor in sensitivity in the case where the foam was applied one day after foaming. The foam will not be suitable for continuous, stable operation on an industrial scale. In Comparative, Examples 10 and 11, in which the resin of emulsion polymerization type was used, the samples of thermosensitive paper are poor in ground fogging and image stability on account of the presence of a surface active agent (as an emulsifier).

In Comparative Example 12 and 13, in which the water-soluble polymer was used, the results are the same as those in Comparative Examples 8 and 9. In Comparative Example 14, in which the water-soluble polymer (used in Comparative Example 12) is incorporated with a foaming agent, the resulting thermosensitive paper is improved in paint stability but is very poor in ground fogging and image stability because the foaming agent solubilizes the dye.

I claim:

1. A thermosensitive recording member which comprises (1) a substrate; (2) a foamed resin layer, provided on said substrate, said foamed resin layer being produced by foaming an aqueous emulsion of a self-emulsifiable resin having a I/O value of 0.6 to 1.1 which is a copolymer obtained from 2 to 25 wt. % of a double bond-containing monomer and having a salt-forming substituent thereon, and 98 to 75 wt. % of a comonomer; and (3) a thermosensitive coloring layer, provided on said foamed resin layer, containing an electron-donating dye and an electron-accepting compound to form a color by reacting with said electron-donating dye.

2. The member as claimed in claim 1, wherein said self-emulsifiable resin has an average particle size of 0.001 to 0.2 microns and a number-average molecular weight of 2,000 to 200,000.

3. The member as claimed in claim 1, wherein said foamed resin layer has an apparent specific gravity of 0.2 to 0.9 and is coated in an amount of 0.1 to 10 g per $m^2$.

4. The member according to claim 1, wherein said self-emulsifiable resin is made up of ethyl acrylate and butyl acrylate monomers.

* * * * *